US009222222B2

(12) United States Patent
Dodd

(10) Patent No.: US 9,222,222 B2
(45) Date of Patent: Dec. 29, 2015

(54) DRIED HIGHLY FIBRILLATED CELLULOSE FIBER

(75) Inventor: Andrew J. Dodd, Seattle, WA (US)

(73) Assignee: Weyerhaeuser NR Company, Federal Way, WA (US)

( * ) Notice: Subject to any disclaimer, the term of this patent is extended or adjusted under 35 U.S.C. 154(b) by 56 days.

(21) Appl. No.: 12/860,132

(22) Filed: Aug. 20, 2010

(65) Prior Publication Data

US 2012/0043038 A1 Feb. 23, 2012

(51) Int. Cl.
*D21H 11/18* (2006.01)
*D21H 13/02* (2006.01)

(52) U.S. Cl.
CPC ..... *D21H 11/18* (2013.01); *D21H 13/02* (2013.01)

(58) Field of Classification Search
CPC ..... D21H 11/18; D21H 13/02
USPC ..... 162/157.7
See application file for complete search history.

(56) References Cited

U.S. PATENT DOCUMENTS 4,374,702 A * 2/1983 Turbak et al. ..... 162/100
4,481,076 A 11/1984 Herrick
5,104,411 A 4/1992 Makoui et al.
6,349,826 B1 * 2/2002 Kapik et al. ..... 206/363
6,465,379 B1 * 10/2002 Cook et al. ..... 442/393
6,524,348 B1 2/2003 Jewell et al.
7,566,014 B2 7/2009 Koslow et al.
2004/0206463 A1 10/2004 Luo et al.
2005/0142973 A1 6/2005 Bletsos et al.
2007/0000627 A1 * 1/2007 Tan et al. ..... 162/30.11
2009/0020139 A1 * 1/2009 Sumnicht et al. ..... 134/6

FOREIGN PATENT DOCUMENTS

WO 9938892 A1 8/1999

OTHER PUBLICATIONS

Shackford, A comparison of Pulping and Bleaching of Kraft Softwood and Eucalyptus Pulps, 2003, 3rd International Pulp and Paer Congress and Exhibition.*
Homonoff, E.C. et al., Nanofibrillated Cellulose Fibers: Where Size Matters in Opening New Markets to Nanofiber Usage, Presentation to 2008 TAPPI Nanotechnology Conference, Jun. 25-27, 2008, St. Louis, MO, US.
Office Action Election/Restrictions, Notification Date: Apr. 27, 2011, U.S. Appl. No. 12/466,227, filed May 14, 2009, Inventor: John A. Westland.
Daicel Chemical Industries, Ltd, "CELISH/Tiara" Products website: https://www.daicel.co.jp/wsp/e/products/selsih/index.html, Aug. 16, 2010.
Canadian Standard Freeness (CSF), TAPPI Standard T 227 om-09, Tentative Standard—1943, Test Method Freeness of pulp (Canadian Standard method), Revised 2009.
Apita Journal 61: 5, p. 396-401, Sep. 2008.
(Continued)

*Primary Examiner* — Anthony Calandra
(74) *Attorney, Agent, or Firm* — Weyerhaeuser Law Dept; Timothy M. Whalen

(57) ABSTRACT

A mixture of lyocell fiber and low DP or standard DP cellulose pulp fiber having a Canadian Standard Freeness of 250 mL CSF or less is dried and has a Canadian Standard Freeness of 250 mL CSF or less. The pulp is 10% to 75% of the total weight of fibers in the mixture. Both the dried product and the process of making it are disclosed.

13 Claims, 8 Drawing Sheets

(56) References Cited

OTHER PUBLICATIONS

Axelsson, Ann, Master's Thesis/Fibre based models for predicting tensile strength of paper, Lulea University of Technology, MSc Programmes in Engineering, Wood Engineering, Department of Skelleftea Campus, Division of Wood Science and Technology, 2009:036 CIV—ISSN:1402-1617—ISRN: LTU-EX—09/036—SE.
SMOOK, Handbook for Pulp and Paper Technologies, 1992, Angus Wilde Publications, 2nd edition, chapters 1 and 13.
ASTM International, D 1795-96 (reapproved 2007), 2007.
Chirat et al., Use of Ozone in a Last Bleaching Stage, 1996, 1996 TAPPI Pulping Conference p. 99-102.
Law, K.N., et al. "Recycling Behavior of Thermomechanical Pulp: Effects of Refining Energy," Technical Association of the Pulp and Paper Industry 79(10):181-186, Oct. 1996.
Ma, P., et al., "Influences of Integrated Tempo-Mediated Oxidation and Recycling on the Properties of TMP Fibers," BioResources 7(2):2260-2271, 2012.
Heald, Editor, Cameron Hydraulic Data, 2002, flowserve, p. 3-104-3-105.
Karlesen, Hanna, Entire Pulp Lines Convert to Submersible Mixers, Feb. 2001, FLYGT.
Scott, et al., Potential Application of Predictive Tensile Strength Models in Paper Manufacture: Part 11—Integration of a Tensile Strength Model with a Dynamic Paper Machine Balance Simulation, 1926, Rev. 2002.

* cited by examiner

DRIED HIGHLY FIBRILLATED CELLULOSE FIBER

The present invention relates to dried highly fibrillated cellulose fiber and specifically to a highly fibrillated mixture of lyocell fiber and cellulose pulp fiber.

As noted in U.S. Pat. No. 5,318,844 an accepted measure of cellulose fiber length and fibrillation is the Canadian Standard Freeness of the pulp. The Canadian Standard Freeness (CSF) is a measure of how "slow" a paper stock is, i.e., how much the stock retards the drainage of water during the forming of the stock into a paper web. The lower the CSF the more closed and dense the paper structure. The CSF is controlled by both the length of the fiber and the degree of fibrillation of the fiber. Canadian Standard Freeness is determined by TAPPI Standard T-227.

A highly fibrillated cellulose fiber is a fiber having a Canadian Standard Freeness of 250 mL CSF or less. A cellulose fiber is a cellulose wood pulp fiber or a lyocell fiber.

Fibrillation of a cellulose fiber, either a natural fiber or a regenerated fiber, causes external and internal segments of the fiber surface to partially detach from the main fiber structure and become fibrils attached by one segment to the main fiber structure. The fibrils provide more structure on the fiber to attach to other fibers in a paper structure.

It has been thought highly fibrillated fibers would lose fibrillation upon drying and not regain fibrillation upon rewetting. It was thought that hydrogen bonding between the fibril and the main fiber structure would rebond the fibril to the main fiber structure and the fibril would not again detach under normal disintegration conditions. In drying there can be hydrogen bonding between fibers causing the fiber to dry under load caused by the fibers being hydrogen bonded at two or more points along the fiber. The Jentzen effect, described by Axelsson, Ann Fibre based models for predicting tensile strength in paper *Master Thesis* Luleå University of Technology, 2009, states that a fiber dried under axial load is straightened out and the fibril angle is reduced and the cellulose and hemicellulose chains rearrange and align themselves parallel to the external load.

This is also shown in the article of Yamauchi and Yamamoto Effects of repeated drying-and-rewetting and disintegration cycles on fundamental properties of kraft pulp fibres and paper made from them *Apita Journal* 61: 5, p 396-401, September 2008. The Canadian Standard Freeness steadily climbed during each cycle of drying and disintegration. The article indicates Canadian Standard Freeness increases with an increase in recycling.

There have been suggestions that low freeness of pulp fibers could be maintained by freeze drying or critical point drying the fibers but these are expensive methods.

This has led to the practice of keeping highly fibrillated fibers in suspension in water at medium or low consistency to maintain the fibrillation. A review of commercial practice shows that fibrillated fibers are offered in water suspension and not dried.

Consequently, a great deal of water is transported with the fibrillated fiber and the cost of transportation increases because of the additional expense of transporting water. Fibrillated material is transported at consistencies ranging from 2% to 30%. At 2% consistency 50 pounds of water are shipped for every pound of fiber. At 10% consistency 10 pounds of water are shipped for every pound of fiber. At 30% consistency 2⅓ pounds of water are shipped for every pound of fiber.

The inventor decided to test the correctness of this widely held belief. He found that a mixture of highly fibrillated lyocell fiber and low DP or standard DP cellulose pulp fiber could be dried and reslurried and would, to a large extent, retain its fibrillation. A fiber mixture having a Canadian Standard Freeness of 250 mL CSF or less would still be at a Canadian Standard Freeness of 250 mL CSF or less after drying. There might be a slight increase in Canadian Standard Freeness but the mixture would still have a Canadian Standard Freeness of 250 mL CSF or less. The widely held belief was not correct.

DESCRIPTION

Starting Materials

Figure 1:
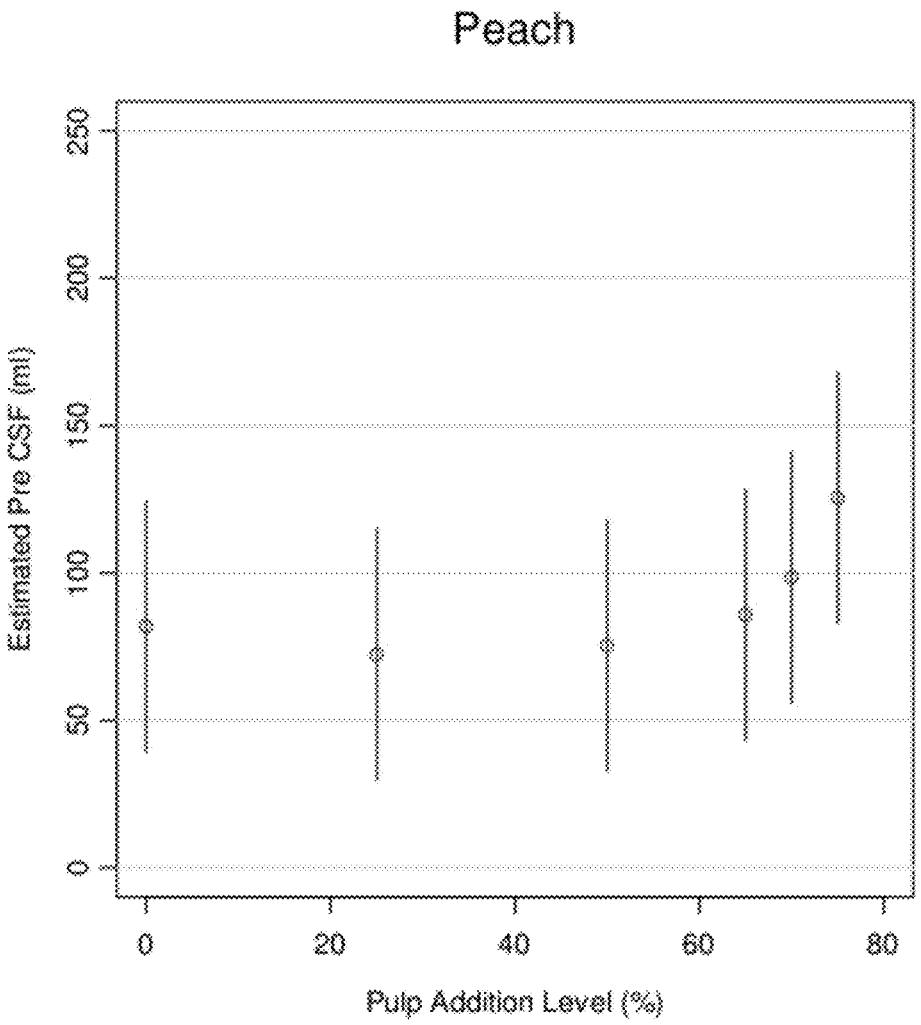
FIG. 1 is a graph showing the Canadian Standard Freeness of different highly fibrillated mixtures of lyocell fiber and a low DP cellulose pulp fiber.
Figure 2:
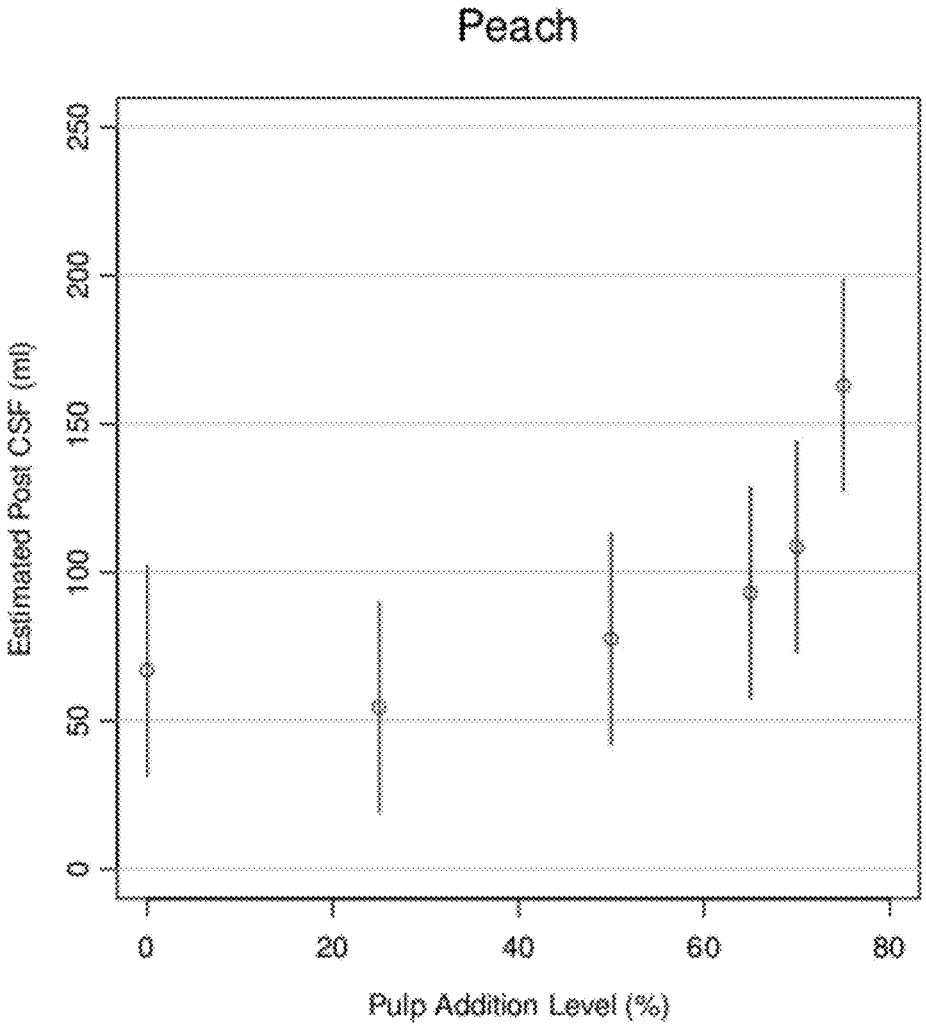
FIG. 2 is a graph showing the Canadian Standard Freeness of these highly fibrillated mixtures of lyocell fiber and a low DP cellulose pulp fiber after the mixtures have been dried and reslurried.

Lyocell fiber and low DP or standard DP cellulose pulp fiber have cellulose, and in some instances hemicellulose and lignin as main constituents. The usual starting materials for both lyocell and the low DP or standard DP cellulose pulp include, but are not limited to, trees, grass and recycled paper. The starting materials, from whatever source, are initially converted to a pulp. The pulp is a chemical wood pulp such as a kraft wood pulp, which can be bleached, lightly bleached or unbleached. The lightly bleached and unbleached pulp will contain lignin. The pulping raw materials are sources of cellulose, hemicellulose and lignin and the terms "wood" or "tree" will be used to generically describe any source of cellulose, hemicellulose and lignin.

In the wood pulping industry, trees are conventionally classified as either hardwood or softwood. Examples of softwood species from which pulp useful as a starting material for both lyocell and low DP or standard DP pulp include, but are not limited to: fir such as Douglas fir and Balsam fir, pine such as Eastern white pine and Loblolly pine, spruce such as White spruce, larch such as Eastern larch, cedar, and hemlock such as Eastern and Western hemlock. Examples of hardwood species from which pulp useful as a starting material for both lyocell and low DP or standard DP pulp include, but are not limited to: acacia, alder such as Red alder and European black alder, aspen such as Quaking aspen, beech, birch, oak such as White oak, gum trees such as eucalyptus and Sweetgum, poplar such as Balsam poplar, Eastern cottonwood, Black cottonwood and Yellow poplar, gmelina and maple such as Sugar maple, Red maple, Silver maple and Bigleaf maple.

Wood from softwood or hardwood species generally includes three major components: cellulose, hemicellulose and lignin. Cellulose makes up about 50% of the woody structure of plants and is an unbranched polymer of D-glucose monomers. Individual cellulose polymer chains associate to form thicker microfibrils which, in turn, associate to form fibrils which are arranged into bundles. The bundles form fibers which are visible as components of the plant cell wall when viewed at high magnification under a light microscope or scanning electron microscope. Cellulose is highly crystalline as a result of extensive intramolecular and intermolecular hydrogen bonding.

The term hemicellulose refers to a heterogeneous group of low molecular weight carbohydrate polymers that are associated with cellulose in wood. Hemicelluloses are amorphous, branched polymers, in contrast to cellulose which is a linear polymer. The principal, simple sugars that combine to form hemicelluloses are: D-glucose, D-xylose, D-mannose, L-arabinose, D-galactose, D-glucuronic acid and D-galacturonic acid.

Lignin is a complex aromatic polymer and comprises about 20% to 40% of wood where it occurs as an amorphous polymer. Lignins can be grouped into three broad classes, including softwood or coniferous (gymnosperm), hardwood (dicotyledonous angiosperm), and grass or annual plant (monocotyledonous angiosperm) lignins. Softwood lignins are often characterized as being derived from coniferyl alcohol or guaiacylpropane (4-hydroxy-3-methoxyphenylpropane) monomer. Hardwood lignins contain polymers of 3,5-dimethoxy-4-hydroxyphenylpropane monomers in addition to the guaiacylpropane monomers. The grass lignins contain polymers of both of these monomers, plus 4-hydroxyphenylpropane monomers. Hardwood lignins are much more heterogeneous in structure from species to species than the softwood lignins when isolated by similar procedures.

Pulping Procedure

In the pulping industry, differences in the chemistry of the principal components of wood are exploited in order to purify cellulose. For example, heated water in the form of steam causes the removal of acetyl groups from hemicellulose with a corresponding decrease in pH due to the formation of acetic acid. Acid hydrolysis of the carbohydrate components of wood then ensues, with a lesser hydrolysis of lignin. Hemicelluloses are especially susceptible to acid hydrolysis, and most can be degraded by an initial steam, prehydrolysis step if one is used in the Kraft pulping process, as will be described in the dissolving pulp section, or in an acidic sulfite cooking process.

With respect to the reaction of wood with alkali solutions, all components of wood are susceptible to degradation by strong alkaline conditions. At the elevated temperature of 140° C. or greater that is typically utilized during Kraft wood pulping, the hemicelluloses and lignin are preferentially degraded by dilute alkaline solutions. Additionally, all components of wood can be oxidized by bleaching agents such as chlorine, oxygen, ozone, sodium hypochlorite and hydrogen peroxide.

Conventional pulping procedures, such as sulfite pulping or alkaline pulping, can be used to provide a wood pulp useful both for making lyocell fibers and for making a low DP and standard DP pulp. An example of a suitable alkaline pulping process is the kraft process, without an acid prehydrolysis step. Normal kraft pulps are not subject to acid prehydrolysis. By avoiding the acid pretreatment step prior to alkaline pulping, the overall cost of producing the pulped wood is reduced. A kraft pulping process with a prehydrolysis step will be discussed under dissolving pulp.

A normal kraft wood pulp would have a hemicellulose content of from 7% to about 30% by weight; and a lignin content of from 0% to about 20% by weight. The lignin content will depend upon the amount of bleaching. Percent by weight when applied to the cellulose or hemicellulose or lignin content of pulp means weight percentage relative to the dry weight of the pulp.

The pulp may be subjected to bleaching by any conventional bleaching process utilizing bleaching agents including, but not limited to, chlorine, chlorine dioxide, oxygen, ozone, sodium hypochlorite, peracids and hydrogen peroxide.

Lyocell

Regenerated cellulose fibers may be prepared using various amine oxides or ionic liquids as solvents. In particular, N-methylmorpholine-N-oxide (NMMO) with about 12% water present proved to be a particularly useful solvent. The cellulose is dissolved in the solvent under heated conditions, usually in the range of 90° C. to 130° C., and extruded from a multiplicity of fine apertured spinnerets into air. The filaments of cellulose dope are continuously mechanically drawn in air by a factor in the range of about three to ten times to cause molecular orientation. They are then led into a nonsolvent, usually water, or water/NMMO mixture to regenerate the cellulose. Other regeneration solvents, such as lower aliphatic alcohols, have also been suggested.

Other solvents that can be mixed with NMMO, or another tertiary amine solvent, include dimethylsulfoxide (DMSO), dimethylacetamide (DMAC), dimethylformamide (DMF) and caprolactan derivatives. Ionic liquids or mixtures of ionic liquids and aprotic or protic liquids are also suitable. Examples of the cation moiety of ionic liquids are cations from the group consisting of cyclic and acyclic cations. Cyclic cations include pyridinium, imidazolium, and imidazole and acyclic cations include alkyl quaternary ammonium and alkyl quaternary phosphorous cations. Counter anions of the cation moiety are selected from the group consisting of halogen, pseudohalogen and carboxylate. Carboxylates include acetate, citrate, malate, maleate, formate, and oxylate and halogens include chloride, bromide, zinc chloride/choline chloride, 3-methyl-N-butyl-pyridinium chloride and benzyldimethyl(tetradecyl)ammonium chloride. Substituent groups, (i.e. R groups), on the cations can be $C_1$, $C_2$, $C_3$, and $C_4$; these can be saturated or unsaturated. Examples of compounds which are ionic liquids include, but are not limited to, 1-ethyl-3-methyl imidazolium chloride, 1-ethyl-3-methyl imidazolium acetate, 1-butyl-3-methyl imidazolium chloride, 1-allyl-3-methyl imidazolium chloride. Pulps used for lyocell will usually fully dissolve in NMMO or ionic liquid in 10 to 90 minutes. Shorter times are preferred. The term "fully dissolve", when used in this context, means that substantially no undissolved particles are seen when a dope, formed by dissolving compositions of the present invention in NMMO or ionic liquids, is viewed under a light microscope at a magnification of 40× to 70×.

Cellulose textile fibers spun from NMMO or ionic liquid solutions are referred to as lyocell fibers. Lyocell is an accepted generic term for a fiber composed of cellulose precipitated from an organic solution in which no substitution of hydroxyl groups takes place and no chemical intermediates are formed. One lyocell product produced by Lenzing AG is presently commercially available as Tencel® fiber. These fibers are available in 0.9-5.7 denier weights and heavier. Denier is the weight in grams of 9000 meters of a fiber. Because of their fineness, yarns made from them produce fabrics having extremely pleasing hands. The term "lyocell" in this applicaton includes polynosic fiber.

Two widely recognized problems of lyocell fabrics are caused by fibrillation of the fibers under conditions of wet abrasion, such as might result during laundering. Fibrillation tends to cause "pilling"; i.e., entanglement of fibrils into small relatively dense balls. It is also responsible for a "frosted" appearance in dyed fabrics. Fibrillation is believed to be caused by the high orientation and apparent poor lateral cohesion within the fibers. There is an extensive technical and patent literature discussing the problem and proposed solutions.

The lyocell can be made from a bleached or unbleached pulp or a mixture of pulp and lignin. The pulp may be a traditional dissolving pulp or a kraft pulp containing hemicellulose and having a DP of 200 to 1100 and a hemicellulose content of 3% to 20% and has been specially treated to be compatible with lyocell solvents such as the amine oxides and ionic liquid and other solvents noted above.

Pulps used for lyocell, including the specially treated kraft pulp, have a number of attributes that allow then to be compatible with the lyocell solvents, such as amine oxide and ionic liquid and other solvents noted above. The lyocell pulps have a copper number of less than about 2.0, and can have a copper number less than about 0.7, as measured by TAPPI T430 cm-99. The lyocell pulps have a carbonyl content of less than about 120 μmol/g and a carboxyl content of less than about 120 μmol/g. The carboxyl and carbonyl group content are measured by TAPPI™ 237 or by means of proprietary assays performed by Thuringisches Institut fur Textil-und Kunstoff Forschunge. V., Breitscheidstr. 97, D-07407 Rudolstadt, Germany.

The lyocell pulps possess a low transition metal content. Preferably, the total transition metal content is less than 20 ppm, more preferably less than 5 ppm, as measured by TAPPI 266 om-94. The term "total transition metal content" refers to the combined amounts, measured in units of parts per million (ppm), of nickel, chromium, manganese, iron and copper. The lyocell pulps have an iron content that is less than 4 ppm, more preferably less than 2 ppm, as measured by TAPPI 266 om-94, and the copper content of pulp used for lyocell is preferably less than 1.0 ppm, more preferably less than 0.5 ppm, as measured by TAPPI 266 om-94.

Additionally, lyocell fibers may have a natural crimp of irregular amplitude and period that confers a natural appearance on the fibers. The crimp amplitude may be greater than about one fiber diameter and the crimp period is greater than about five fiber diameters.

Processes for Forming Fibers

As described above, one process for forming lyocell fibers is the dry jet/wet process. In this process the filaments exiting the spinneret orifices are mechanically drawn through an air gap and then submerged and coagulated and stretched mechanically in a liquid bath before drying. Dried lyocell fiber can be cut to different length from 2 to 12 mm. Never dried lyocell can be cut to 2 to 12 mm too and used directly for fibrillation.

Another process is generally termed "melt blowing". The fibers are extruded through a series of small diameter orifices into an air stream flowing generally parallel to the extruded fibers. This draws or stretches the fibers. The stretching serves two purposes. It causes some degree of longitudinal molecular orientation and reduces the ultimate fiber diameter. Meltblowing typically produces fibers having a small diameter (most usually less than 10 μm) which are useful for producing non-woven materials.

In one embodiment of the melt-blowing method, the dope is transferred at somewhat elevated temperature to the spinning apparatus by a pump or extruder at temperatures from 70° C. to 140° C. Ultimately the dope is directed to an extrusion head having a multiplicity of spinning orifices. The dope filaments emerge into a relatively high velocity turbulent gas stream flowing in a generally parallel direction to the path of the latent fibers. As the dope is extruded through the orifices the liquid strands or latent filaments are drawn (or significantly decreased in diameter and increased in length) during their continued trajectory after leaving the orifices. The turbulence induces a natural crimp and some variability in ultimate fiber diameter both between fibers and along the length of individual fibers. The crimp is irregular and will have a peak to peak amplitude that is usually greater than about one fiber diameter with a period usually greater than about five fiber diameters. At some point in their trajectory the fibers are contacted with a regenerating solution. Regenerating solutions are nonsolvents such as water, lower aliphatic alcohols, or mixtures of these. The NMMO used as the solvent can then be recovered from the regenerating bath for reuse. Preferably the regenerating solution is applied as a fine spray at some predetermined distance below the extrusion head.

A somewhat similar process is called "spunbonding" where the fiber is extruded into a tube and stretched by an air flow through the tube caused by a vacuum at the distal end. In general, spunbonded fibers are continuous while melt blown fibers are more usually in discrete shorter lengths.

Another process, termed "centrifugal spinning", differs in that the fiber is expelled from apertures in the sidewalls of a rapidly spinning drum. The fibers are drawn somewhat by air resistance as the drum rotates. However, there is not usually a strong air stream present as in meltblowing.

Dissolving Grade Pulp

Most currently available lyocell fibers are produced from high quality wood pulps that have been extensively processed to remove non-cellulose components, especially hemicellulose. These highly processed pulps are referred to as dissolving grade or high alpha (or high α) pulps, where the term alpha (or α) refers to the percentage of cellulose (TAPPI, T 203 CM-99). Thus, a high alpha pulp contains a high percentage of cellulose, and a correspondingly low percentage of other components, especially hemicellulose. The processing required to generate a high alpha pulp and the fact that pulp yield is less because a high alpha pulp contains less of the starting raw material significantly adds to the cost of lyocell fibers and products manufactured from lyocell fibers.

Dissolving grade pulps are traditionally produced by the sulfite process but the kraft process can be used with certain modifications.

When the kraft process is used to produce a pulp, a mixture of sodium sulfide and sodium hydroxide is used to pulp the wood. Conventional kraft processes stabilize residual hemicelluloses against further alkaline attack, so it is not possible to obtain acceptable quality dissolving pulps, i.e., high alpha pulps, through subsequent treatment of kraft pulp in the bleaching stages because the hemicellulose remains in the pup. In order to prepare dissolving type pulps by the kraft process, it is necessary to give the raw material an acidic pretreatment before the alkaline pulping stage. A significant amount of material primarily hemicellulose, on the order of 10% or greater of the original wood substance, is solubilized in this acid phase pretreatment and thus process yields drop. Under the prehydrolysis conditions, the cellulose is largely resistant to attack, but the residual hemicelluloses are degraded to a much shorter chain length and can therefore be removed to a large extent in the subsequent kraft cook by a variety of hemicellulose hydrolysis reactions or by dissolution.

The prehydrolysis stage normally involves treatment of wood at elevated temperature (150° C.-180° C.) with dilute mineral acid (sulfuric or aqueous sulfur dioxide) or with water alone requiring times up to 2 hours at the lower temperatures. In the latter case, liberated acetic acid from certain of the naturally occurring polysaccharides (predominantly the mannans in softwoods and the xylan in hardwoods) lowers the pH below 4.

A non-dissolving kraft pulp may also be used for lyocell. It has its degree of polymerization adjusted to 200 to 1100 and its copper number and transition metals adjusted to be compatible with the lyocell solvents. It will be described hereafter.

Degree of Polymerization

The term "degree of polymerization" (abbreviated as DP) refers to the number of D-glucose monomers in a cellulose molecule. Thus, the term "average degree of polymerization", or "average DP", refers to the average number of D-glucose molecules per cellulose polymer in a population of cellulose polymers.

The DP of a pulp will depend on the species of wood being used. Hardwoods and softwoods will have different DPs. The DP of a pulp will also depend on the pulping system and bleaching system being used. A kraft paper pulp which retains hemicellulose will have a higher DP than a kraft or some sulfite dissolving pulps which has far less and usually no hemicellulose. Some dissolving pulps can have a high DP.

The DP of a pulp will also depend of the method of measuring it. The measurements of DP in this application are by ASTM Test D 1795-96 which uses a Cuene (cupriethylenediamine) solvent. Other tests use a Cuam (cuprammonium hydroxide) solvent or a LiCl/DMAc (lithium chloride/dimethylacetamide) solvent. Klemme et al., *Comprehensive Organic Chemistry*, Vol. 1, Fundamentals and analytical methods, Wiley-VCH 1998, report the following DP for pulps using Cuam: Papergrade softwood pulp: greater than 1000, dissolving grade softwood pulp: 300-1700, paper grade hardwood pulp: greater than 1000, dissolving grade hardwood pulp: 300-1000.

Sixta *Handbook of pulp, Vol.* 2, Wiley-VCH 2006 lists pine kraft pulp with ECF bleaching to have a $DP_v$ of 2207 measured with a Cuene solvent and $DP_w$ 2827 and a. $DP_n$ of 659 measured with LiCl/DMAc/cellulose solution using GPC procedure.

Sixta also shows the DP for different species, pulping systems and bleaching systems. Sixta provide the following DP: kraft pine with ECF (elemental chlorine free) bleaching has a Cuene DP of 2207 and a Cuam DP of 2827, kraft spruce with TCF (total chlorine free) bleaching has a Cuene DP of 1648 and a Cuam DP of 2251, eucalyptus kraft with ECF bleaching has a Cuene DP of 2355 and a Cuam DP of 2847, beech sulfite pulp with ECF bleaching has a Cuene DP of 2240 and a Cuam DP of 2636, spruce sulfite pulp with TCF bleaching has a Cuene DP of 3074 and a Cuam DP of 3648, spruce sulfite pulp with ECF bleaching has a Cuene DP of 2486 and a Cuam DP of 3144, and beech sulfite pulping with TCF bleaching has a Cuene DP of 3489 and a Cuam DP of 4050. It is noted that the Cuam method has higher DPs than the Cuene method.

The DP distribution can be unimodal, i.e., the modal DP value being the DP value that occurs most frequently within the distribution, or multimodal, i.e., a distribution of cellulose DP values that has several relative maxima. A multimodal, treated pulp might be formed, for example, by mixing two or more unimodal, treated pulps, each having a different modal DP value. The distribution of cellulose DP values can be determined by GPC method (Sixta *Handbook of pulp, Vol.* 2, Wiley-VCH 2006).

In this application, a low DP pulp is a pulp having a DP of 1000 or less. In one embodiment the low DP pulp has a DP of 200 to 1000. In another embodiment the low DP pulp has a DP of 300 to 850. In this application, a standard DP pulp is a pulp having a DP greater than 1000. In one embodiment the standard DP pulp has a DP of 1000 to 4500. In another embodiment the standard DP pulp would have a DP of 1000 to 3000. In another embodiment a standard DP pulp would have a DP of 1000 to 2500. Peach® pulp is exemplary of a low DP pulp. NB 416 is exemplary of a standard DP pulp. Both are available from Weyerhaeuser NR Company.

Lowering the Degree of Polymerization

There are methods for reducing the DP of a non-prehydrolyzed kraft pulp to a DP in the range of 200 to 1000 or a DP in the range of 300 to 850, or a DP in the range of 400 to 750. It may be done without substantially reducing the hemicellulose content. The pulp can be a bleached, semi-bleached or unbleached kraft softwood pulp. Low DP saw dust pulp, lyocell pulp or viscose grade pulp can be manufactured using these methods.

This DP reduction treatment occurs after the pulping process and before, during or after the bleaching process, if a bleaching step is utilized. This includes a portion of the DP reduction step occurring at the same time as a portion of the bleaching step. Preferably the bleaching step, if utilized, occurs before treatment to reduce the average DP of the cellulose.

The methods of reducing the DP can include treating pulp with acid, or an acid substitute, or a combination of acids and acid substitutes, steam, alkaline chlorine dioxide, cellulase, the combination of at least one transition metal and a peracid, preferably peracetic acid, and the combination of ferrous sulfate and hydrogen peroxide.

The following methods are illustrative.

A means of treating the pulp in order to reduce the average DP of the cellulose without substantially reducing the hemicellulose content is to treat the pulp with acid. Any acid can be utilized, including, but not limited to: hydrochloric, phosphoric, sulfuric, acetic and nitric acids, provided only that the pH of the acidified solution can be controlled. Sulfuric acid is used because it is a strong acid that does not cause a significant corrosion problem when utilized in an industrial scale process. Additionally, acid substitutes can be utilized instead of, or in conjunction with, acids. An acid substitute is a compound which forms an acid when dissolved in the solution containing the pulp. Examples of acid substitutes include sulfur dioxide gas, nitrogen dioxide gas, carbon dioxide gas and chlorine gas.

The acid, or combination of acids, is preferably utilized in an amount of from about 0.1% w/w to about 10% w/w in its aqueous solution, and the pulp is contacted with the acid for a period of from about 2 minutes to about 5 hours at a temperature of from about 20° C. to about 180° C. The amount of acid or acid substitute will be sufficient to adjust the pH of the pulp to a value within the range of from about 0.0 to about 5.0. The amount, time, temperature and pH can be at a range within these ranges. The rate at which DP reduction occurs can be increased by increasing the temperature and/or pressure under which the acid treatment is conducted. Preferably the pulp is stirred during acid treatment, although stifling should not be vigorous.

When the reagent is steam, the steam is preferably utilized at a temperature of from about 120° C. to about 260° C., at a pressure from about 150 psi to about 750 psi, and the pulp is exposed to the steam for a period from about 0.5 minutes to about 10 minutes. The steam may include at least one acid. The steam may include an amount of acid sufficient to reduce the pH of the steam to a value within the range from about 1.0 to about 4.5. The exposure of the pulp to both acid and steam permits the use of lower pressure and temperature to reduce the average DP of the cellulose compared to the use of steam alone.

When the reagent is a combination of at least one transition metal and peracetic acid, the transition metal(s) is present at a concentration from about 5 ppm to about 50 ppm, the peracetic acid is present at a concentration from about 5 mmol per liter to about 200 mmol per liter, and the pulp is contacted with the combination for a period from about 0.2 hours to about 3 hours at a temperature from about 40° C. to about 100° C.

When the reagent is a combination of ferrous sulfate and hydrogen peroxide, the ferrous sulfate is present at a concentration from about 0.1 M to about 0.6 M, the hydrogen peroxide is present at a concentration from about 0.1% v/v (volume to volume) to about 1.5% v/v, and the pulp is contacted with the combination for a period from about 10 minutes to about one hour at a pH from about 3.0 to about 5.0.

Yet other means of treating the pulp in order to reduce the average DP of the cellulose, but without substantially reducing the hemicellulose content, is to treat the pulp with alkaline chlorine dioxide or with alkaline sodium hypochlorite, oxygen, or ozone.

The hemicellulose content of the treated pulp, expressed as a weight percentage, is from about 7% by weight to about 30% by weight or a range within that range. As used herein, the term "percent (or %) by weight" or "weight percentage", when applied to the hemicellulose or lignin content of treated pulp, means weight percentage relative to the dry weight of the treated pulp.

Hemicellulose content can be measured by a sugar content assay based on TAPPI T249 cm-00. The hemicellulose content often is estimated to be the total of the xylan and mannan content. Lignin content in the same sample can be estimated from the solid residue after filtration of sugar solution from hydrolyzed samples.

Copper Number

If a nonprehydrolyzed kraft pulp is used for lyocell then its DP needs to be reduced as discussed above and it is further treated to lower the copper number to a value of less than 2.0, more preferably less than about 1.1, most preferably less than about 0.7, as measured by TAPPI T430 cm-99. A low copper number is desirable because it is generally believed that a high copper number causes cellulose degradation during and after dissolution. The copper number is an empirical test used to measure the reducing value of cellulose. The copper number is expressed in terms of the number of milligrams of metallic copper which is reduced from cupric hydroxide to cuprous oxide in alkaline medium by a specified weight of cellulosic material. The copper number of the treated pulp can be reduced, for example, by treating the pulp with sodium borohydride or sodium hydroxide or by treating the pulp with one or more bleaching agents including, but not limited to, sodium hypochlorite, chlorine dioxide, peroxides (such as hydrogen peroxide) and peracids (such as peracetic acid).

The copper number of the low DP pulp used in the blend with lyocell fiber does not need a low copper number and need not be treated to reduce the copper number. It can, however, have a reduced copper number.

Dried Mixture of Fibrillated Fiber

Applicant has found that fibrillated mixtures of lyocell and low DP or standard DP pulp having a Canadian Standard Freeness of 250 or less can be dried and reslurried and maintain a Canadian Standard Freeness of 250 mL CSF or less. In one embodiment the amount low DP or standard DP pulp is from 10% to 75% of the weight of the mixture of pulp and lyocell. In one embodiment the amount low DP or standard DP pulp is from 20% to 75% of the weight of the mixture of pulp and lyocell. In one embodiment the amount low DP or standard DP pulp is from 25% to 75% of the weight of the mixture of pulp and lyocell. In another embodiment the amount of low DP or standard DP pulp is from 25% to 70% of the weight of the mixture of pulp and lyocell. In another embodiment the amount of low DP or standard DP pulp is from 25% to 65% of the weight of the pulp and lyocell. Over the same processing time there is a sharp increase in Canadian Standard Freeness of the mixture at when the pulp is 75% of the weight of the mixture of lyocell and pulp.

The lyocell fibers in the mixture have a length of 12 mm or less. In one embodiment the lyocell has a length of 2 to 12 mm. In one embodiment the lyocell has a length of 3 to 10 mm. In one embodiment the lyocell has a length of 4 to 8 mm. In each of these embodiments fibril of the fibrillated lyocell usually has a diameter or width in the range of 30 to 1000 nanometers to provide an aspect ratio of greater than 100 to one million or more.

The length and width of the pulp fibers will depend upon the species being used for the pulp.

Drying can be by any means. It can be by oven drying, through air drying, jet drying, contact drying or any other means of drying. The temperature of the drying can be from 60° C. to 150° C. The time of drying will depend upon the type of drying. It can be from a few seconds for jet drying to several hours for oven drying. The time of drying will also depend upon the final moisture content of the dried mixture of fibers. The drying step can include water or liquid removal by filtering, centrifuging or other removal means prior to heat treatment. In one embodiment of the invention the water or moisture in the dried mixture of fibrillated fibers is from 0% to 30% of the weight of the fibers and water. In another embodiment of the invention the water or moisture in the dried mixture of fibrillated fibers is 0% to 10% of the weight of fibers and water. Stored fibers tend to come to equilibrium with the moisture in the surrounding atmosphere.

The fibers may be formed into a sheet before drying and the sheet may be formed into a roll.

The highly fibrillated mixture of lyocell fibers and pulp fibers, either low DP pulp or standard DP pulp, having a Canadian Standard Freeness of 250 mL CSF or less will have a Canadian Standard Freeness of 250 mL CSF or less after drying to a liquid content of 0% to 30% of the total weight of the fibers and liquid. The highly fibrillated mixture of lyocell fibers and pulp fibers, either low DP pulp or standard DP pulp, having a Canadian Standard Freeness of 250 mL CSF or less will have a Canadian Standard Freeness of 250 mL CSF or less after drying to a liquid content of 0% to 10% of the total weight of the fibers and liquid.

Fillers, such as clay, have been used to maintain fibrillation of a fiber, or inhibit hydrogen bonding of the fibrils, during and after drying. Other fillers may include, but are not limited to, carboxymethyl cellulose, dextrin, maltodextrin, locust bean gum, xanthan gum, guar gum, polyhydroxy compounds, carbohydrates, saccharides (mono, di or poly), glycols. lecithin, and alkali metal salts of borates, polyborates, phosphates and polyphosphates. In the present process and product fillers are not used to maintain fibrillation or inhibit hydrogen bonding.

EXAMPLE 1

In these examples Peach® pulp was used as an example of a low DP pulp and NB 416 pulp was used as an example of a standard DP pulp. Both pulps are available from Weyerhaeuser NR Company.

Two buckets of ~40° C. deionized water (31.05 kg) were added to a lab scale hydrapulper and the pulper was turned on. To this, a bucket of 6 mm 1.7 dtex dull lyocell (0.6 OD kg at 92% solids) that had been soaking in deionized water (14.43 kg) for 15 minutes was added slowly. From another bucket deionized water (14.48 kg) that had been used to soak dried Peach® pulp sheet (1.4 OD kg at 91.5% solids) that had been soaking for four hours was added. The soaked Peach® pulp sheet was then slowly added to the hydrapulper. A final bucket of deinonized water (10.77 kg) was added to reach the target consistency. The lab scale hydrapulper was then run for 90 min.

Three 2 L samples were collected and labeled 15294-47-(1, 2, 3) and samples 47-1 and 47-2 had the Canadian Standard Freeness (CSF) measured following the TAPPI standard T 227 om-09. After the aliquot necessary to measure CSF was removed, the rest of sample 47-1 (939.4 g) was dried in a 9×12 pan in a 105° C. oven overnight. This was repeated for sample 47-2 (1049.4 g). These oven dried samples then had the Canadian Standard Freeness (CSF) measured following the TAPPI standard T 227 om-09.

This procedure was repeated for the additional samples for low DP and standard DP pulp and for different mixtures of lyocell and pulp.

The results are shown in Table 1.

The above data was then used for the graphs shown in FIGS. 1-8. In each of these figures the mean value for the Canadian Standard Freeness of each of the groupings is shown. The 95% confidence interval for each of the values is also shown.

Figure 3:
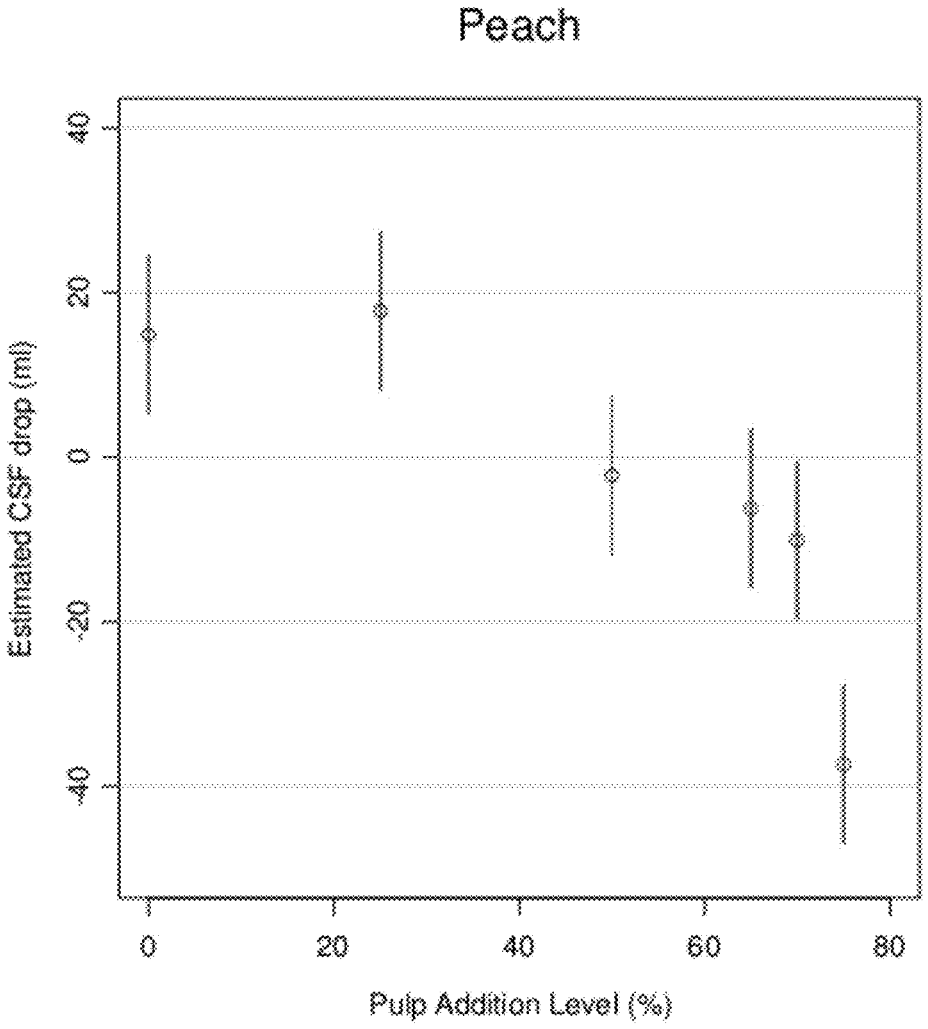
FIG. 3 is a graph showing the drop in Canadian Standard Freeness from FIG. 1 to FIG. 2.
Figure 4:
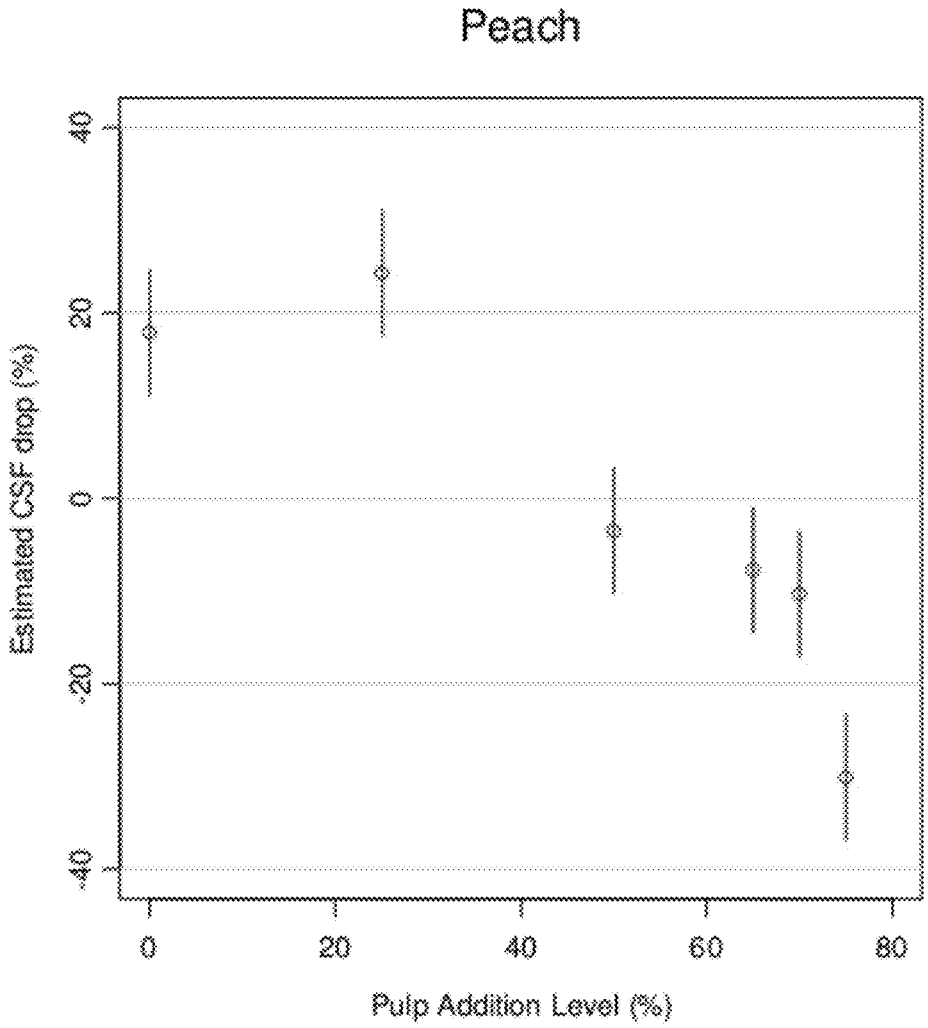
FIG. 4 is a graph showing the percentage drop in Canadian Standard Freeness from FIG. 1 to FIG. 2.
Figure 5:
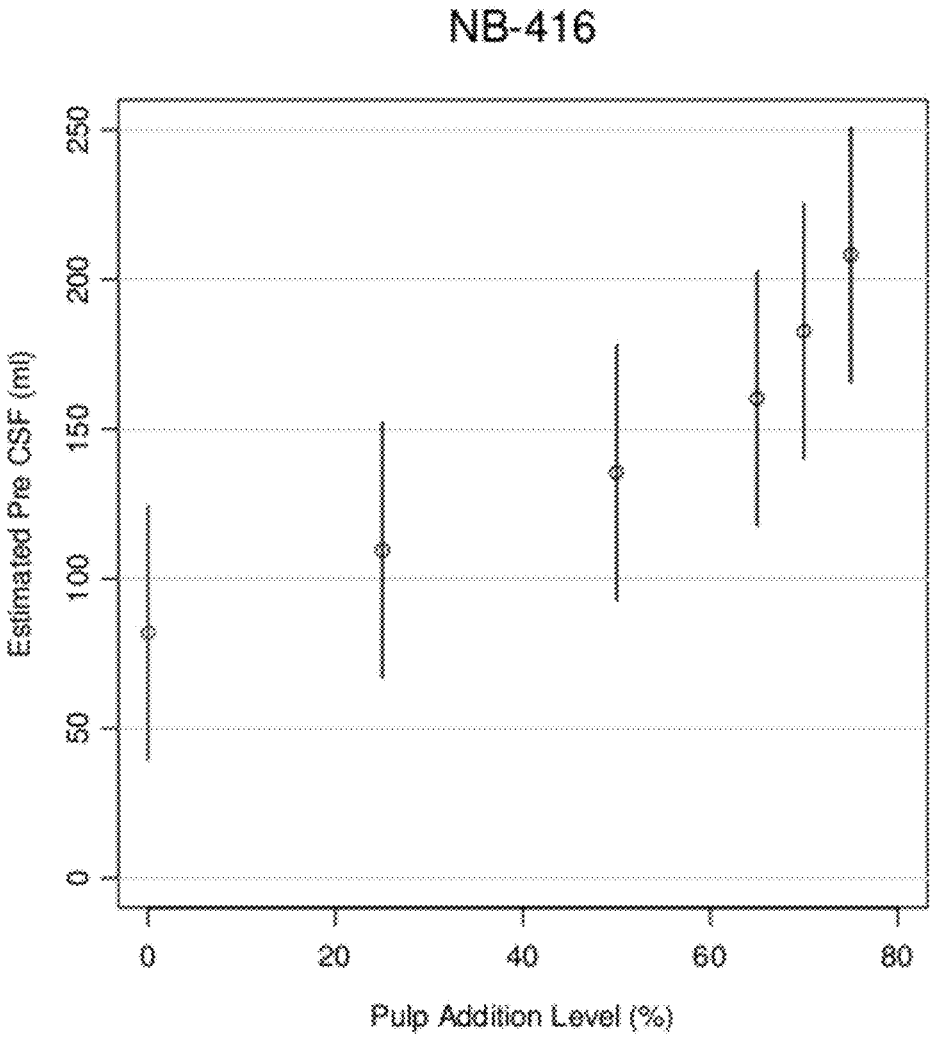
FIG. 5 is a graph showing the Canadian Standard Freeness of different highly fibrillated mixtures of lyocell fiber and a standard DP cellulose pulp fiber.
Figure 6:
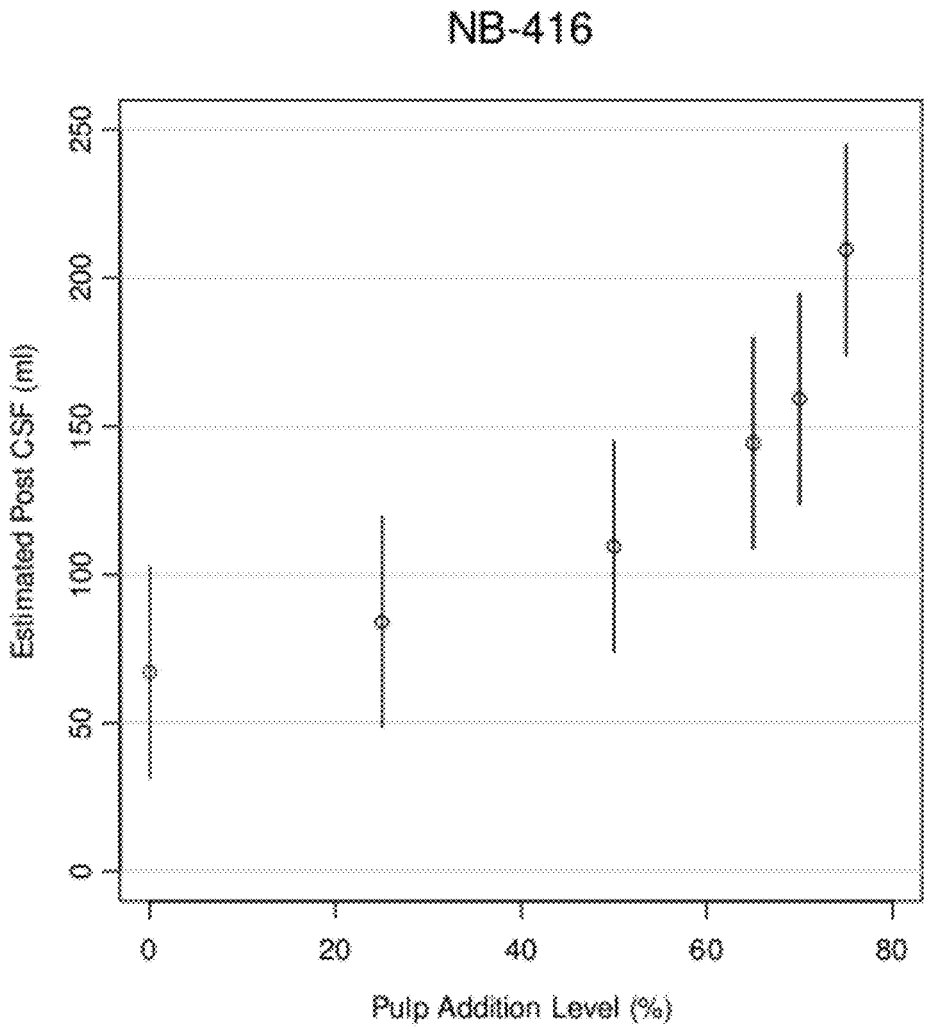
FIG. 6 is a graph showing the Canadian Standard Freeness of these highly fibrillated mixtures of lyocell fiber and a standard DP cellulose pulp fiber after the mixtures has been dried and reslurried.
Figure 7:
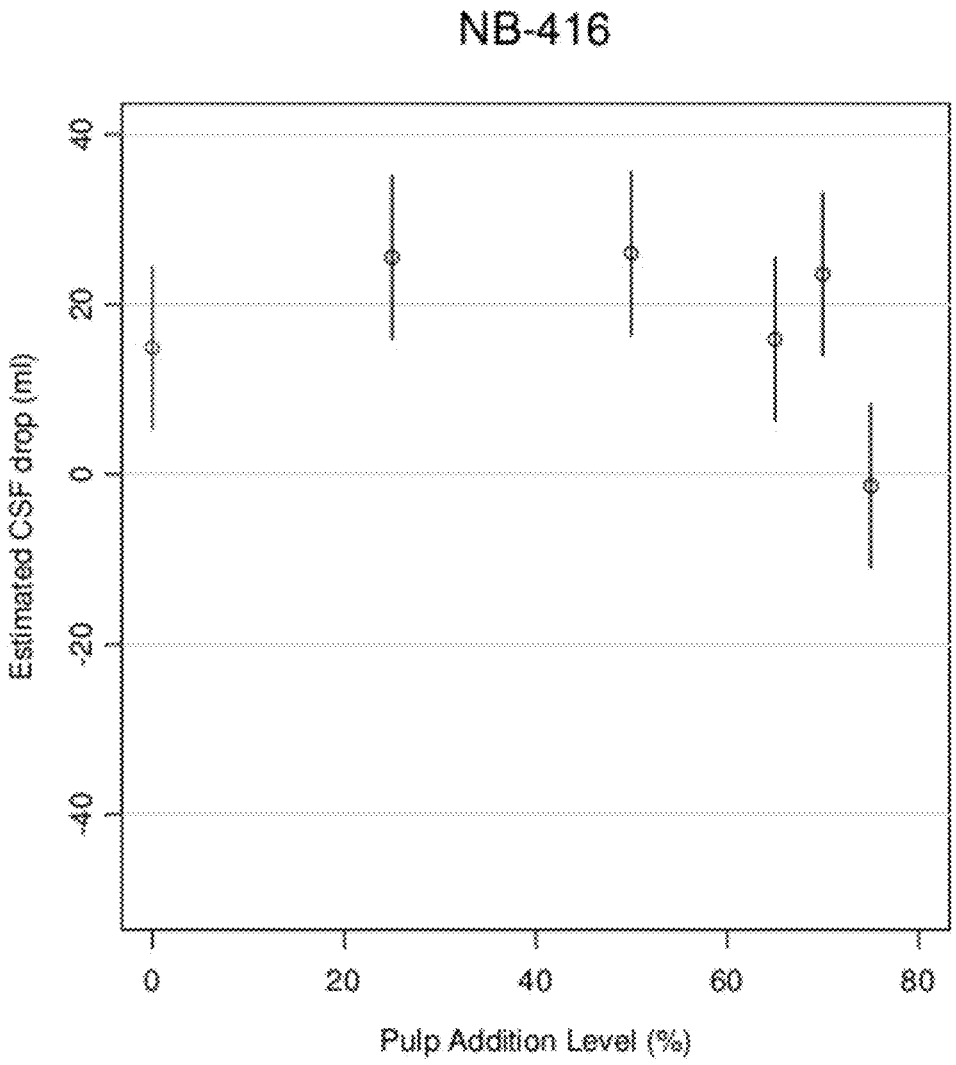
FIG. 7 is a graph showing the drop in Canadian Standard Freeness from FIG. 5 to FIG. 6.
Figure 8:
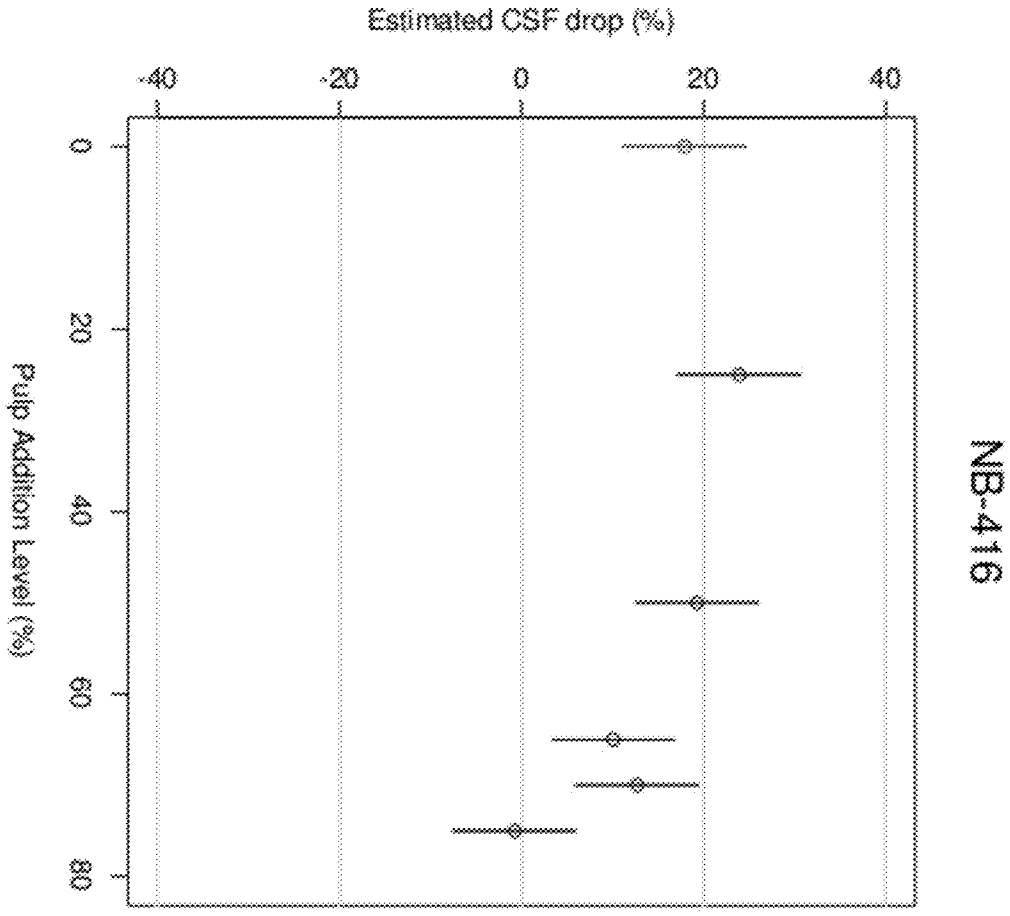
FIG. 8 is a graph showing the percentage drop in Canadian Standard Freeness from FIG. 5 to FIG. 6.

FIGS. 3 and 7 show that at the 75% pulp addition level there is an abrupt drop in the trend line for Canadian Standard Freeness drop with either low DP pulp or standard DP pulp. This trend line is fairly constant below the 75% level of pulp addition.

These results are surprising. It was not thought the highly fibrillated mixture of lyocell and pulp would remain highly fibrillated after drying because of the beliefs and articles indicated Canadian Standard Freeness would increase. In these examples the Canadian Standard Freeness remained in the range of 250 mL CSF or less.

While the preferred embodiments of the invention have been illustrated and described, it will be appreciated that various changes can be made without departing from the spirit and scope of the invention.

TABLE 1

| | | Pulp | Soak | mL CSF | | | Oven dry mL CSF | | |
|---|---|---|---|---|---|---|---|---|---|
| Example | Lyocell | Peach | time | 1 | 2 | 3 | 1 | 2 | 3 |
| 65-1 | 25 | 75 | 4 hours | 119 | 116 | | 144 | 148 | |
| 65-2 | | | 4 hours | 110 | 110 | | 161 | 154 | |
| 70-1 | | | ON | 132 | 137 | | 167 | 172 | |
| 70-2 | | | ON | 138 | 142 | | 175 | 182 | |
| 47-1 | 30 | 70 | 4 hours | 101 | 102 | | 115 | 116 | |
| 47-2 | | | 4 hours | 100 | 101 | | 105 | 103 | |
| 63-1 | | | ON | 98 | 101 | | 107 | 108 | |
| 63-2 | | | ON | 93 | 92 | | 104 | 111 | |
| 50-1 | 35 | 65 | ON | 91 | 97 | | 99 | 92 | |
| 50-2 | | | ON | 86 | 94 | | — | — | |
| 58-1 | | | 4 hours | 77 | 82 | | 88 | 93 | |
| 58-2 | | | 4 hours | 80 | 79 | | 89 | 92 | |
| 48-1 | 50 | 50 | ON | 67 | 73 | | 73 | 69 | |
| 48-2 | | | ON | 63 | 65 | | 76 | 72 | |
| 68-1 | | | 4 hours | 81 | 84 | | 87 | 83 | |
| 68-2 | | | 4 hours | 82 | 87 | | 81 | 79 | |
| 62-1 | 75 | 25 | 4 hours | 58 | 57 | | 39 | 41 | |
| 62-2 | | | 4 hours | 52 | 53 | | 44 | 45 | |
| 71-1 | | | 4 hours | 90 | 87 | | 65 | 68 | |
| 71-2 | | | 4 hours | 92 | 89 | | 69 | 65 | |
| 64-1 | 100 | 0 | 15 min | 76 | 75 | | 64 | 65 | |
| 64-2 | | | 15 min | 74 | 75 | | 62 | 66 | |
| 69-1 | | | 15 min | 87 | 90 | | 68 | 69 | |
| 69-2 | | | 15 min | 92 | 86 | | 70 | 72 | |
| | | NB-416 | Soak | 1 | 2 | 3 | 1 | 2 | 3 |
| 56-1 | 25 | 75 | OW | 195 | 191 | | 186 | 181 | |
| 56-2 | | | OW | 166 | 171 | | 183 | 186 | |
| 66-1 | | | ON | 240 | 228 | | 230 | 227 | |
| 66-2 | | | ON | 236 | 238 | | 244 | 239 | |
| 49-1 | 30 | 70 | ON | 197 | 201 | | 168 | 172 | |
| 49-2 | | | ON | 193 | 187 | | 156 | 159 | |
| 59-1 | | | ON | 162 | 166 | | 161 | 159 | |
| 59-2 | | | ON | 180 | 176 | | 150 | 149 | |
| 57-1 | 35 | 65 | OW | 148 | 147 | | 134 | 132 | |
| 57-2 | | | OW | 134 | 136 | | 119 | 115 | |
| 67-1 | | | ON | 180 | 179 | | 158 | 161 | |
| 67-2 | | | ON | 188 | 176 | 173 | 165 | 171 | |
| 52-1 | 50 | 50 | ON | 161 | 177 | 164 | 138 | 140 | |
| 52-2 | | | ON | 171 | 158 | 174 | 130 | 135 | |
| 60-1 | | | ON | 102 | 101 | | 82 | 79 | |
| 60-2 | | | ON | 107 | 104 | | 86 | 86 | |
| 51-1 | 75 | 25 | ON | 146 | 147 | | 107 | 107 | |
| 51-2 | | | ON | 145 | 141 | | 118 | 119 | |
| 61-1 | | | 4 hours | 74 | 73 | | 53 | 52 | |
| 61-2 | | | 4 hours | 76 | 74 | | 59 | 57 | |

ON is overnight considered to be 20 hours

OW is over the weekend considered to be 66 hours

The invention claimed is:

1. A dried fibrillated mixture of lyocell fibers and softwood cellulose pulp fibers, the mixture having been formed by fibrillating the pulp fibers together with unfibrillated lyocell fibers and then drying;

wherein the mixture has a Canadian Standard Freeness of 250 mL CSF or less, wherein the softwood cellulose pulp fibers in the mixture is in the range of 20% to 70% of the total weight of the fibers in the mixture, the lyocell fibers is in the range of at least 20% of the total weight of the fibers in the mixture, and the mixture has a water content from 0% to 30% of the weight of the fibers in the mixture and water, and wherein the Canadian Standard Freeness does not exceed 250 mL CSF upon re-slurrying.

2. The mixture of claim 1 wherein the softwood cellulose pulp has a DP of 200 to 1000 as measured by ASTM Test D 1795-96.

3. The mixture of claim 1 wherein the softwood cellulose pulp has a DP of greater than 1000 as measured by ASTM Test D 1795-96.

4. The mixture of claim 1 wherein the mixture has a water content from 0% to 10% of the weight of the fibers in the mixture and water.

5. The mixture of claim 4 wherein the softwood cellulose pulp has a DP of 200 to 1000 as measured by ASTM Test D 1795-96.

6. The mixture of claim 4 wherein the softwood cellulose pulp has a DP of greater than 1000 as measured by ASTM Test D 1795-96.

7. A method of providing a dried fibrillated mixture of lyocell fibers and softwood cellulose pulp fibers, the method comprising:

fibrillating a mixture of unfibrillated lyocell fibers and softwood cellulose pulp fibers in water to a Canadian Standard Freeness of 250 mL CSF or less, wherein the softwood cellulose pulp fibers in the mixture is in the range of 20% to 70% of the total weight of the fibers in the fiber mixture and the lyocell fibers in the range of at least 20% of the total weight of the fibers in the mixture; and drying the fiber mixture and water until the water content of the mixture is 0% to 30% of the weight of the fibers in the mixture and water.

8. The method of claim 7 wherein the softwood cellulose pulp has a DP of 200 to 1000 as measured by ASTM Test D 1795-96.

9. The method of claim 7 wherein the softwood cellulose pulp has a DP of greater than 1000 as measured by ASTM Test D 1795-96.

10. The method of claim 7 wherein the water content of the mixture is 0% to 10% of the weight of the fibers in the fibers in the mixture and water.

11. The method of claim 10 wherein the softwood cellulose pulp has a DP of 200 to 1000 as measured by ASTM Test D 1795-96.

12. The method of claim 10 wherein the softwood cellulose pulp has a DP of greater than 1000 as measured by ASTM Test D 1795-96.

13. A fibrillated mixture of lyocell fibers and softwood cellulose pulp fibers, the mixture having been formed by fibrillating the pulp fibers together with unfibrillated lyocell fibers;

wherein the mixture has a Canadian Standard Freeness of 250 mL CSF or less;

wherein the mixture comprises softwood cellulose pulp fibers in the range of 20% to 70%, and lyocell fibers of at least 20%, of the total weight of the fibers in the mixture;

wherein the mixture has a water content greater than about 30% of the weight of the fibers in the mixture and water; and wherein the Canadian Standard Freeness of the mixture does not exceed 250 mL upon drying the mixture to a water content of below 30% of the weight of the fibers in the mixture and water.

* * * * *